US005731121A

United States Patent [19]

Asanae et al.

[11] Patent Number: 5,731,121

[45] Date of Patent: Mar. 24, 1998

[54] DEVELOPER FOR ELECTROSTATIC LATENT IMAGE DEVELOPMENT

[75] Inventors: Masumi Asanae; Akihiko Funakawa, both of Kumagaya; Masahisa Ochiai, Fukaya, all of Japan

[73] Assignee: Hitachi Metals, Ltd., Tokyo, Japan

[21] Appl. No.: 711,743

[22] Filed: Sep. 10, 1996

[30] Foreign Application Priority Data

Sep. 12, 1995 [JP] Japan ..... 7-234151

[51] Int. Cl.[6] ..... G03G 9/083

[52] U.S. Cl. ..... 430/106.6; 430/122

[58] Field of Search ..... 430/106, 106.6, 430/108, 110, 122

[56] References Cited

U.S. PATENT DOCUMENTS

| | | | |
|---|---|---|---|
| 4,693,952 | 9/1987 | Koizumi et al. | 430/110 |
| 5,225,301 | 7/1993 | Yushina et al. | 430/106 |
| 5,552,252 | 9/1996 | Lundy et al. | 430/106.6 |

FOREIGN PATENT DOCUMENTS

| | | |
|---|---|---|
| 63-220172 | 9/1988 | Japan . |
| 1-172843 | 7/1989 | Japan . |
| 1-172844 | 7/1989 | Japan . |
| 1-214874 | 8/1989 | Japan . |
| 2-110572 | 4/1990 | Japan . |
| 7-77834 | 3/1995 | Japan . |
| 7-77836 | 3/1995 | Japan . |

*Primary Examiner*—John Goodrow

*Attorney, Agent, or Firm*—Morgan, Lewis & Bockius LLP

[57] ABSTRACT

A developer for developing an electrostatic latent image by a developing method of a type in which residual toner particles on an image-bearing member are recovered therefrom and reused for developing the electrostatic latent image, which comprises a magnetic toner and a magnetic carrier. The magnetic toner comprises a binder resin having a number average molecular weight of 2,000–100,000, a weight average molecular weight of 5,000–500,000, and a melt viscosity of $10^5$ P or less at 120° C., a release agent having a softening point of 160° C. or lower; and a magnetic powder. The magnetic toner particle is externally added on a surface thereof or internally added thereto with a surface treating agent comprising a fine powder of at least one metal salt of stearic acid, a fine powder of at least one inorganic oxide and an optional resin powder.

12 Claims, No Drawings

DEVELOPER FOR ELECTROSTATIC LATENT IMAGE DEVELOPMENT

BACKGROUND OF THE INVENTION

The present invention relates to a developer for developing electrostatic latent images in a visual image-forming process which involves a step for developing electrostatic latent images, a step for transferring the developed toner images to a recording sheet, a cleaning step for removing toners remaining on an image-bearing member not transferred, and a step for supplying the recovered toners to a developing zone.

In an visual image-forming process such as electrophotography, electrostatic printing and electrostatic recording, an electrostatic latent image corresponding to the original informational areas to be reproduced is recorded on a photosensitive or dielectric surface. The latent image is developed by bringing toner particles into contact therewith to form a toner image on the photosensitive or dielectric surface, and the toner image is subsequently transferred to a recording sheet such as paper. The transferred toner image is fixed to the recording sheet by heating and/or applying pressure to give a printed image.

Heat and pressure fixing using heating rolls is common in current use. This heating-roll fixing is superior in heat efficiency due to direct contact of the toner particles on the recording sheet with the surface of the heating rolls under pressure, and has an advantage of ensuring a high speed fixing. The surface of the heating rolls is usually made of a releasing material to prevent the toner particle from adhering to the surface. However, since the surface of the heating rolls is brought into direct contact with the fused toner particles under pressure, some of the fused toner particles adhere to the roll surface. The adhered toner particles on the roll surface are retransferred to the recording sheet at the subsequent contact therewith to soil the recording sheet (offset phenomenon). Therefore, it is important to prevent the toner particles from adhering to the surface of the heating rolls when the heating roll fixing is employed.

Further, to meet the recent demand for a high speed and energy saving electrophotographic apparatus such as copying machines, printer, etc., developers which may be fixed at low temperature, i.e., developers having a good fixing ability at low temperature have been proposed.

For example, JP-A-1-172843 and JP-A-1-172844 discloses, as a toner satisfactory in both the fixing ability at low temperature and offset resistance, toners containing a binder resin characterized by molecular distribution peaks at $3\times10^3$ to $5\times10^3$ and at $1.5\times10^5$ to $2.0\times10^6$ and a peak area ratio (from $1.5\times10^5$ to $2.0\times10^6$) of 40–60% or by the gel content of 1–10%. With these toners, the fixing ability at low temperature and the offset resistance have been improved in development by an electrophotographic apparatus of medium to low speed.

Recently, a high speed electrophotographic apparatus capable of copying or printing 50 A4-size papers or more per minute has been required to speed up the information processing. Generally, all the toner particles in the toner images on a image-bearing member are not transferred to a recording sheet, and about 10–20 weight % of the toner particles remain on the image-bearing member not transferred. The residual toner particles on the image-bearing member are subsequently removed therefrom by a cleaning means to result in a large amount, especially in a high speed apparatus, of waste toner. Since the disposal of the waste toner is likely to cause environmental pollution, the recycling of the waste toner has come to be considered in the art.

However, when the waste toner is recycled for developing the latent images, there have been several problems such as deterioration in image density, severe background fogging, severe reverse fogging, filming which is a thin layer of the residual toner particles formed on the surface of image-bearing member, etc. Therefore, the toner to be recycled is required to have a filming resistance, a good durability and an ease of being transported to a developing step in addition to a good developability, a good fixing ability at low temperature and an offset resistance.

To meet such requirements, JP-A-63-220172 discloses a toner containing a non-linear polyester as the binder resin and a low molecular weight polyolefin, JP-A-1-214874 teaches a toner containing, as the binder resin, a specific polyester obtained from aliphatic diol, JP-A-2-110572 discloses a toner containing a metal-crosslinked styrene-acrylic copolymer as the binder resin and a large amount of polyolefin, and JP-A-7-77836 proposes a toner containing a resin composition having a specific molecular weight range as the binder resin and a polyolefin having a specific molecular weight range as the release agent.

However, these toners are still insufficient for preventing filming of the toner particles on the image-bearing member when a blade-cleaning method is employed for removing the residual toner particles from the image-bearing member, which cleaning method is now widely employed in the recording or printing apparatus in view of reduction in size and weight and reliability. More specifically, a binder resin having a low molecular weight and a low glass transition temperature ($T_g$) has been conventionally used to lower the viscosity of fused toner. Due to the low viscosity, the fused toner are spread out on the recording sheet to broaden the contact surface between the fused toner and the recording sheet, this enabling the toner particles to be sufficiently fixed to the recording sheet at low temperature. However, during the blade-cleaning step to remove the residual toner particles on the image-bearing member, the toner particles are heated by friction with the blade. When the temperature of the toner particles reaches the glass transition temperature, the toner particles are fused to the surface of the image-bearing member, i.e., the filming of the toner occurs, and also, the toner particles are fused to each other.

OBJECT AND SUMMARY OF THE INVENTION

Accordingly, an object of the present invention is to provide a developer for developing electrostatic latent images containing toner particles which cause no background fogging and filming and are excellent in fixing ability at low temperature to produce images of high density after repeated recycling of the recovered toner particles.

As a result of the intense research in view of the above objects, the inventors have found that the friction between a cleaning blade and the toner particles can be reduced and the above object is achieved by using toner particles comprising a specific binder resin, a release agent and a magnetic powder, which toner particles are externally added on the surface thereof or internally added thereto a particular surface treating agent.

Thus, in the present invention, there is provided a developer for developing an electrostatic latent image by a developing method of a type in which residual toner particles on an image-bearing member are recovered therefrom and reused for developing the electrostatic latent image, comprising a magnetic toner and a magnetic carrier, wherein the magnetic toner comprises 35–85 weight % of a binder resin having a number average molecular weight of 2,000–100,000, a weight average molecular weight of 5,000–500,000, and a melt viscosity of $10^5$ P or less at 120° C., 1–10 weight % of a release agent having a softening point of 160° C. or lower, and 10–60 weight % of a magnetic powder, the magnetic toner being externally added on a surface thereof or internally added thereto with a surface treating agent comprising a fine powder of at least one metal salt of stearic acid, a fine powder of at least one inorganic oxide and optionally a fine resin powder.

DETAILED DESCRIPTION OF THE INVENTION

The developer of the present invention is a two-component magnetic developer comprising a magnetic carrier and a magnetic toner. The magnetic toner comprises a binder resin, a release agent and a magnetic powder, the surface of the toner particles being externally added with a surface treating agent.

The binder resin used in the present invention has a number average molecular weight (Mn) of 2,000–100,000, preferably 5,000–50,000, and a weight average molecular weight (Mw) of 5,000–500,000, preferably 10,000–400,000, more preferably 20,000–300,000, both being determined by gel permeation chromatography (GPC). With the above molecular weight distributions, the toner particles are provided with good characteristics favorable for visual image processing. When either Mn or Mw is lower than the above ranges, the offset resistance, blocking resistance, filming resistance, etc. cannot be improved. Further, the toner particles, particularly the residual toner particles on the image-bearing member are likely to be broken to make the recycling of the toner particles difficult. On the other hand, either Mn or Mw is larger than the above ranges, the fixing of the toner particles to the recording sheet is insufficient and the productivity of the developer is reduced due to difficulty in pulverizing. In addition, the internal additives are not well dispersed throughout the toner particles.

A melt viscosity of the binder resin is $10^5$ P (poise) or less at 120° C. The melt viscosity was determined by a flow tester (CFT-500 manufactured by Shimadzu Corporation) equipped with a nozzle of 1 mm inner diameter and 10 mm length using 1 g of sample under the conditions of a load of 30 kgf, preheating at 80° C. for 3 minutes, and a temperature rising rate of 3° C./min. The melt viscosity at 120° C. was determined from a measured temperature-viscosity curve. When the melt viscosity exceeds $10^5$ P, the fixing temperature cannot be lowered and the fixing is insufficient. When the melt viscosity is too low, cold offset and hot offset are likely to be caused during the fixing operation. Therefore, the lower limit of the melt viscosity is preferred to be $10^3$ P.

The amount of the binder resin to be contained in the toner is 35 to 85 weight %, preferably 40 to 75 weight % based on the total amount of the toner.

The binder resin may include vinyl resin, polyester, polyurethane, epoxy resin, polyamide, polyvinyl butyral, rosin, modified rosin, terpene resin, phenol resin, aliphatic or aliphatic hydrocarbon resin, aromatic petroleum resin, etc. These binder resins may be used alone or in combination of two or more. Of the above resins and polymers, the vinyl resin and crosslinked polyester are preferable. As the preferred vinyl resin, exemplified is a styrene copolymer such as styrene-acrylic copolymer and styrene-methacrylic copolymer. These copolymers may be block copolymer or graft copolymer. As the monomer constituting the crosslinked polyester, a crosslinkable monomer having at least two polymerizable double bonds such as aromatic divinyl compounds especially divinylbenzene, diacrylate compound, etc. may be used.

The vinyl resin may be synthesized by various method. A bulk polymerization produces a low molecular weight polymer by increasing the rate of termination reaction at high temperature. However, this method involves disadvantage of difficulty in controlling the reaction. In a solution polymerization, a low molecular weight polymer or copolymer can be obtained under mild conditions by utilizing the difference in radical chain transfer between the solvents and adjusting the used amount of the polymerization initiator and/or polymerization temperature. Therefore, this method is preferable as the production method when a low molecular weight polymer is used as the binder resin.

As the production method for a highly-crosslinked, high-molecular weight polymer, emulsion polymerization and suspension polymerization are preferable. In emulsion polymerization, fine droplets of a monomer practically insoluble in water are dispersed in a continuous water phase by the use of an emulsifier, and the monomer is polymerized in the presence of a water-soluble polymerization initiator. In this method, the polymerization heat can be easily removed from the reaction system to ensure an easy control of polymerization temperature. Also, since the rate of termination reaction is small because the droplets in which polymerization is proceeding is isolated from the water phase, the rate of polymerization is large to result in a high polymerization degree. Further, the polymerization process is relatively simple and the product is fine granular polymer, this facilitating mixing of the binder resin with additives such as colorant, charge-controlling agent, etc. in toner production. Thus emulsion polymerization is advantageous as the production method of the binder resin as compared with other polymerization methods. However, this method also involves defects that the obtained resin may be contaminated with the emulsifier and additional operation such as salting-out is required to recover the product.

In suspension polymerization which is a simple and easy method for producing the binder resin, a dispersed mixture of a monomer and a low-molecular weight polymer or copolymer is polymerized with a crosslinking agent. By this method, a pearl polymer composition containing uniformly mixed low-molecular weight polymer or copolymer and crosslinked medium- to high-molecular weight polymer or copolymer may be obtained. The amount of the monomer to be used is preferred to be 100 weight parts or less, preferably 10–90 weight parts per 100 weight parts of water or an aqueous medium.

The release agent may be a polyolefin wax, such as polypropylene, polyethylene, etc., having a softening point of 160° C. or lower and an average molecular weight of 2,000 to 15,000. When the softening point exceeds 160° C., the fixing temperature cannot be lowered and the fixing is insufficient. Since the storage stability of the toner is deteriorated, the softening point is preferred to be 60° C. or higher. The release agent may be contained in the toner in an amount of 1–10 weight % based on the total amount of the toner. When the content is less than 1 weight %, the offset cannot be effectively prevented. A content exceeding 10 weight % lowers the fluidity of the toner particles to result in agglomeration of the toner particles.

The magnetic powder may be a ferromagnetic alloy or compound containing iron, cobalt, nickel, etc. such as ferrite, magnetite, etc. Various alloys showing ferromagnetism as a result of treatment such as heat treatment may be also used as the magnetic powder. Since the average particle size of the toner is 5–15 μm, the magnetic powder is preferred to have an average particle size of 0.02–3 μm. The magnetic powder may be contained in an amount of 10–60 weight % based on the total amount of the toner. When the content is less than 10 weight %, the toner particles tend to be scattered from the developing roll (magnet roll) due to a low magnetic force. On the other hand, when the content exceeds 60 weight %, the fixing of the toner particles to the recording sheet is insufficient because the content of the binder resin is too low.

In the preparation of the toner of the present invention, for example, the binder resin, release agent, magnetic powder and an optional additive such as a charge-controlling agent, pigment, dye, etc. are mechanically mixed in a mixing machine such as a ball mill, etc. to give a uniform mixture. In a kneading machine such as heating roll, kneader, etc., the resin constituents of the mixture are molten by heating and the magnetic powder and the additive are well dispersed or dissolved in the molten resin so that a homogeneous dispersion or solution is achieved. After cooling, the solidified material is pulverized to the volume average particle size range of 5–15 μm, preferably 6–10 μm. When the average particle size is less than 5 μm, the background fogging occurs and the fluidity of the toner is lowered. When exceeding 15 μm, the images produced on the recording sheet are rough to lower the resolution.

The toner described above is externally added on the surface thereof or internally added thereto a surface treating agent to improve charge stability, image quality, developability, fixing ability, fluidity, durability, and filming resistance. The surface treating agent comprises a fine powder of at least one metal stearate, a fine powder of at least one inorganic oxide, and optionally a fine resin powder mainly containing, preferably containing about 70 weight % or more of a fluorine resin. The addition amounts of the constituents based on 100 weight parts of the toner are 0.05–1 weight part for the fine powder of at least one metal stearate, 0.5–2 weight parts for the fine powder of at least one inorganic oxide, and 0.1–1 weight part for the fine resin powder mainly containing a fluorine resin. When the amount of the fine powder of at least one metal stearate is less than 0.05 weight part, the filming is likely to occur on the image-bearing member, and the background fogging tends to occur when exceeding 1 weight part. When the amount of the fine powder of at least one inorganic oxide is less than 0.5 weight part, the fluidity of the toner particles is low, and the toner particles are not sufficiently fixed to the recording sheet when the amount exceeds 2 weight parts.

The number average particle size of each powder for the surface treating agent is preferably 0.001–2 μm, more preferably 0.05–1 μm. A powder having an average particle size less than 0.001 μm is difficult to be handled. When the average particle size exceeds 1 μm, the surface treating agent cannot be uniformly added to the surface of the toner particles.

As the metal stearate, zinc stearate, magnesium stearate, calcium stearate, etc. may be used alone or in combination, and preferred is zinc stearate.

As the inorganic oxide, exemplified are silica, alumina, titanium oxide, zinc oxide, antimony oxide, tin oxide, cerium oxide, etc. To make the fine powder of these inorganic oxide hydrophobic or to control the chargeability of the toner, the fine powder may be treated by a treating agent such as silicone varnish, modified silicone varnishes, silicone oil, silane coupling agent with or without organic functional groups, other organosilicon compounds in combination with or without other treating agent.

As the fluorine resin, exemplified are polyvinyl fluoride, polyvinylidene fluoride, polytrifluoroethylene, halofluoropolymer such as polytrifluorochloroethylene, polytetrafluoroethylene, polyhexafluoropropylene, vinylidene fluoride-acrylic copolymer, vinylidene fluoride-trifluorochloroethylene copolymer, tetrafluoroethylene-hexafluoropropylene copolymer, vinyl fluoride-vinylidene fluoride copolymer, vinylidene fluoride-tetrafluoroethylene copolymer, vinylidene fluoride-hexafluoropropylene copolymer, tetrafluoroethylene-vinylidene fluoride-non-fluorinated monomer terpolymer, etc. These polymers may be used alone or in combination of two or more.

The weight average molecular weight of the fluorine resin is preferably 50,000–400,000, more preferably 100,000–250,000.

The surface treating agent can be externally added to the surface of the toner particles, for example, by mechanically mixing a suitable amount of the surface treating agent with the toner particles in a mixer. The mechanical mixing may be carried out during or after the pulverizing step of toner production. Alternatively, the surface treating agent may be internally added to the toner particles by mechanically mixing the surface treating agent with the constituents for the toner such as a binder resin, release agent, magnetic powder and optional additive or additives.

Material for the magnetic carrier used in the present invention may include metals, alloys and oxides of iron, nickel, cobalt, manganese, chromium, rare earth elements, etc. which may be subjected to surface oxidation. The oxides is preferable, and more preferred is ferrite. The magnetic carrier may comprise only a magnetic material, a combination of a magnetic material and a non-magnetic material, or a mixture of two or more magnetic materials. The production method of the magnetic carrier is not critical in the present invention, and conventionally known methods may be employed.

The weight average particle size of the carrier is preferably 10–100 μm, more preferably 20–80 μm, particularly preferably 30–60 μm. When less than 10 μm, the carrier particles tend to adhere to the surface of the image-bearing member, this causing damage of the image-bearing member and cleaning blade due to scratching. An average particle size exceeding 100 μm reduces the amount of the toner particles attracted on the carrier particle to result in uneven solid images, toner scattering, background fogging, etc.

To prevent the toner spent, improve the durability of the carrier in a high-speed apparatus, and control the efficiency for charging the toner particles, the carrier described above may be covered with a coating of resin such as styrene-acrylic resin, fluorine resin, silicone compound, etc. As the fluorine resin, those for the surface treating agent, described above, may be used. As the silicone compound, exemplified are polysiloxane such as dimethyl polysiloxane, methyl phenyl polysiloxane, etc. and modified silicone such as alkoxide-modified silicone, epoxy-modified silicone, polyester-modified silicone, urethane-modified silicone, acryl-modified silicone, etc. Such modified silicone may include block copolymer, graft copolymer and comb-shaped graft copolymer.

The resin coating can be made by applying a solution or suspension of the resin in a suitable solvent on the carrier surface. The amount of the resin to be coated on the carrier depends on film-forming properties of the resin and the durability of the resultant resin coating, and is preferably 0.1–30 weight %, more preferably 0.5–20 weight % based on the amount of the carrier.

The developer of the present invention may be prepared by mechanically mixing the magnetic toner and the magnetic carrier, both being described above. The toner content in the developer (toner concentration) is preferably 10–95 weight % based on the total amount of the developer. When the content is less than 10 weight %, the carrier particles which predominates in the developer are likely to be attracted to the image-bearing member. On the other hand, a content exceeding 95 weight % causes the blurring of produced images.

The present invention will be further described while referring to the following Examples which should be considered to illustrate various preferred embodiments of the present invention.

Examples 1–11 and Comparative Examples 1–5

Preparation of Magnetic Toner A-1

Starting materials consisting, by weight part, of:

50 parts of styrene-n-butyl methacrylate copolymer (binder resin), 45 parts of magnetite (magnetic powder, EPT500 manufactured by Toda Kogyo K.K.), 3 parts of polypropylene (release agent), and 2 parts of a negatively chargeable charge-controlling agent (Bontron E-81, Cr-containing azo-pigment manufactured by Orient Chemical Industries)

were subjected to a dry pre-mixing in a ball mill, melt-kneaded under heating, solidified by cooling, pulverized in a jet mill and classified to obtain toner particles having an average particle size of 10 μm.

The toner particles obtained above, zinc stearate having an average particle size of 0.05 μm and hydrophobic silica (inorganic oxide, Aerosil R972 manufactured by Nippon Aerosil K.K.) were mixed in a mixer to prepare toner particles added on the surface thereof with 0.05 weight part of zinc stearate and 0.5 weight part of hydrophobic silica based on 100 weight parts of the toner (toner A-1).

Preparation of Magnetic Toners A-2 to A-8

The same toner particles prepared above was added with respective amounts of zinc stearate, hydrophobic silica and polyvinylidene fluoride (fluorine resin, average particle size of 1 μm, Kynar (trade name) manufactured by Pennwalt Co. Ltd.) to obtain each surface-treated toner (A-2 to A-8).

Preparation of Magnetic Toners A-9 and A-10

Starting materials consisting, by weight part, of:

55 parts of styrene-n-butyl methacrylate copolymer (binder resin), 40 parts of magnetite (magnetic powder, EPT500 manufactured by Toda Kogyo K.K.), 3 parts of polypropylene (release agent), and 2 parts of a negatively chargeable charge-controlling agent (Bontron E-81, Cr-containing azo-pigment manufactured by Orient Chemical Industries)

were subjected to the same procedures as above to prepare toner particles. The toner particles were added with zinc stearate, hydrophobic silica, polyvinylidene fluoride and titanium oxide (inorganic oxide, average particle size: 1.5 μm) to obtain surface-treated toners A-9 and A-10.

Preparation of Magnetic Toner A-11 and A-12

Starting materials consisting, by weight part, of:

50 parts of styrene-n-butyl methacrylate copolymer (binder resin), 45 parts of magnetite (magnetic powder, EPT500 manufactured by Toda Kogyo K.K.), 3 parts of polypropylene (release agent), and 2 parts of a negatively chargeable charge-controlling agent (Bontron E-81, Cr-containing azo-pigment manufactured by Orient Chemical Industries) were subjected to the same procedures as above to prepare toner particles. The toner particles were added with zinc stearate and hydrophobic silica to obtain surface-treated toners A-11 and A-12.

The characteristics of the surface-treated toners A-1 to A-12 are shown in Table 1.

TABLE 1

| | Toner | | | | | |
|---|---|---|---|---|---|---|
| | Binder Resin | | | Release Agent | | Magnetic Powder |
| No. | Melt viscosity at 120° C. (P) | Mw | Mn | M[2] | Softening point[3] (°C.) | Addition amount (weight %) |
| A-1 | $5 \times 10^3$ | $1.8 \times 10^4$ | $0.4 \times 10^4$ | 14000 | 153 | 45 |
| A-2 | $5 \times 10^3$ | $1.8 \times 10^4$ | $0.4 \times 10^4$ | 14000 | 153 | 45 |
| A-3 | $5 \times 10^3$ | $1.8 \times 10^4$ | $0.4 \times 10^4$ | 14000 | 153 | 45 |
| A-4 | $5 \times 10^3$ | $1.8 \times 10^4$ | $0.4 \times 10^4$ | 14000 | 153 | 45 |
| A-5 | $5 \times 10^3$ | $1.8 \times 10^4$ | $0.4 \times 10^4$ | 14000 | 153 | 45 |
| A-6[1] | $5 \times 10^3$ | $1.8 \times 10^4$ | $0.4 \times 10^4$ | 14000 | 153 | 45 |
| A-7[1] | $5 \times 10^3$ | $1.8 \times 10^4$ | $0.4 \times 10^4$ | 14000 | 153 | 45 |
| A-8[1] | $5 \times 10^3$ | $1.8 \times 10^4$ | $0.4 \times 10^4$ | 14000 | 153 | 45 |
| A-9 | $3 \times 10^4$ | $1.5 \times 10^5$ | $0.4 \times 10^4$ | 8500 | 149 | 40 |
| A-10 | $3 \times 10^4$ | $1.5 \times 10^5$ | $0.4 \times 10^4$ | 8500 | 149 | 40 |
| A-11[1] | $5 \times 10^5$ | $6 \times 10^5$ | $1.2 \times 10^5$ | 8500 | 149 | 45 |
| A-12[1] | $5 \times 10^5$ | $6 \times 10^5$ | $1.2 \times 10^5$ | 8500 | 149 | 45 |

Note:
[1]Comparative toners.
[2]Measured by vapor pressure osmometry.
[3]Measured by differential scanning calorimetry (DSC).

| | Surface Treating Agent Addition amount (weight part) | | | | Volume Average | Specific Volume | Triboelectric |
|---|---|---|---|---|---|---|---|
| No. | Zinc stearate | Hydrophobic silica | Titanium oxide | Polyvinylidene fluoride | Particle Size (μm) | Resistance (Ω · cm) | Charge (μC/g) |
| A-1 | 0.05 | 0.5 | — | — | 10 | $4 \times 10^{14}$ | −23 |
| A-2 | 0.2 | 0.5 | — | 0.3 | 10 | $4 \times 10^{14}$ | −23 |

TABLE 1-continued

| | | | | | | | |
|---|---|---|---|---|---|---|---|
| A-3 | 0.5 | 0.5 | — | — | 10 | $4 \times 10^{14}$ | −23 |
| A-4 | 0.7 | 0.5 | — | — | 10 | $4 \times 10^{14}$ | −23 |
| A-5 | 1.0 | 0.5 | — | — | 10 | $4 \times 10^{14}$ | −23 |
| A-6[1)] | — | 0.5 | — | — | 10 | $4 \times 10^{14}$ | −23 |
| A-7[1)] | — | 0.5 | — | 0.3 | 10 | $4 \times 10^{14}$ | −23 |
| A-8[1)] | 1.2 | 0.5 | — | — | 10 | $4 \times 10^{14}$ | −23 |
| A-9 | 0.2 | 0.7 | — | 1.0 | 10 | $2 \times 10^{15}$ | −21 |
| A-10 | 0.2 | 0.7 | 0.5 | 1.0 | 10 | $2 \times 10^{15}$ | −21 |
| A-11[1)] | — | 0.5 | — | — | 10 | $6 \times 10^{15}$ | −24 |
| A-12[1)] | 0.2 | 0.5 | — | — | 10 | $6 \times 10^{15}$ | −24 |

Note:
[1)]Comparative toners.

The volume-average particle size of the toner was measured by a particle size analyzer (Coulter Counter Model TA-II manufactured by Coulter Electronics Co.). The triboelectric charge of the toner was measured by using a blow-off triboelectric charge measuring apparatus (TB-200 manufactured by Toshiba Chemical Co. Ltd.).

Preparation of Magnetic Carrier

Five kinds of the carriers shown in Table 2 were prepared according to known methods.

TABLE 2

| No. | Magnetic Material | Coating | Weight Average Particle Size (μm) | Specific Volume Resistance (Ω · cm) | Saturation Magnetization (emu/g) |
|---|---|---|---|---|---|
| B-1 | iron powder (flat) | silicone resin | 30 | $2 \times 10^{8}$ | 192 |
| B-2 | iron powder (flat) | none | 30 | $2 \times 10^{5}$ | 192 |
| B-3 | Cu—Zn ferrite | none | 60 | $7 \times 10^{8}$ | 68 |
| B-4 | Cu—Zn ferrite | silicone resin | 60 | $5 \times 10^{10}$ | 68 |
| B-5 | $Fe_3O_4$ | silicone resin | 50 | $7 \times 10^{12}$ | 93 |

The weight-average particle size of the carrier was calculated from a particle size distribution obtained by a multi-sieve shaking machine. The saturation magnetization was measured by a vibrating magnetometer (VSM-3 manufactured by Toei Kogyo K.K.) under maximum magnetic field of 10 kOe.

The specific volume resistance of the toner and carrier was determined as follows. An appropriate amount (about 10 mg) of the toner or carrier was charged into a Teflon (trade name) cylinder having an inner diameter of 3.05 min. The sample was exposed to an electric field of D.C. 4 kV/cm (magnetic toner) or D.C. 100 V/cm (magnetic carrier) under a load of 100 gf to measure an electric resistance using an insulation-resistance tester (4329A manufactured by Yokogawa-Hewlett-Packard, Ltd.).

Image-Forming Test

Each developer having a toner concentration of 40 weight % shown in Table 3 was prepared by mixing the surface-treated toner and the carrier obtained above.

The image-forming test was carried out under the following conditions.

Photoconductive drum (image-bearing member)
OPC (organic photoconductor)
surface potential: −500 V
peripheral speed: 25 mm/sec
Developing roll
stationary permanent magnet of 4 magnetic poles
developing pole: N pole
surface magnetic flux density: 800 G
Sleeve
SUS304
outer diameter: 20 mm
peripheral speed: 150 mm/sec
Developing gap: 0.4 mm
Doctor gap: 0.3 mm The toner image on the photoconductive drum was corona-transferred to A4-size paper and the transferred toner was fixed thereto by heating rolls at 135° C. under a line pressure of 1 kgf/cm. The residual toner particles on the photoconductive drum were recovered by an urethane blade and returned to the developing unit to be reused.

The images formed on paper were examined on the image density (ID), the occurrence of fogging, the fixing strength, and the occurrence of filming.

The image density was obtained by measuring the reflectance optical density of solid black portion using a Macbeth densitometer.

The occurrence of fogging was determined based on the whiteness degree of the recording sheet measured by a color difference meter before and after the recording sheet was subjected to the developing operation.

The fixing strength was determined as follows. A piece of Scotch mending tape (trade name) was stuck on the image having an image density ($ID_0$) of 1.3 or more. The image density ($ID_1$) after removing the tape was measured, and the fixing strength was calculated from the equation of $ID_1/ID_0 \times 100$.

When the black spots were found with the naked eye in the non-image portion on the recording sheet after developing operation as well as on the surface of the photoconductive drum, the filming was determined to occur.

The results of the tests are shown in Table 3.

TABLE 3

| | | | Initial stage of developing | | | After 50000-sheet developing | | |
|---|---|---|---|---|---|---|---|---|
| No. | Toner | Carrier | ID | Fogging | Fixing strength (%) | ID | Fogging | Filming |
| Examples | | | | | | | | |
| 1 | A-1 | B-1 | 1.35 | ○ | 98 | 1.32 | ○ | ○ |
| 2 | A-2 | B-1 | 1.40 | ○ | 96 | 1.39 | ○ | ○ |
| 3 | A-3 | B-1 | 1.41 | ○ | 95 | 1.38 | ○ | ○ |
| 4 | A-4 | B-1 | 1.43 | ○ | 95 | 1.40 | ○ | ○ |
| 5 | A-5 | B-1 | 1.43 | ○ | 94 | 1.41 | ○ | ○ |
| Comparative Examples | | | | | | | | |
| 1 | A-6 | B-1 | 1.36 | ○ | 98 | 1.27 | ○ | x |
| 2 | A-7 | B-1 | 1.32 | ○ | 98 | 1.21 | ○ | x |
| 3 | A-8 | B-1 | 1.43 | x | 93 | 1.40 | x | ○ |
| Examples | | | | | | | | |
| 6 | A-9 | B-1 | 1.40 | ○ | 95 | 1.38 | ○ | ○ |
| 7 | A-10 | B-1 | 1.40 | ○ | 91 | 1.42 | ○ | ○ |
| Comparative Examples | | | | | | | | |
| 4 | A-11 | B-1 | 1.38 | ○ | 87 | 1.35 | ○ | x |
| 5 | A-12 | B-1 | 1.38 | ○ | 87 | 1.35 | ○ | ○ |
| Examples | | | | | | | | |
| 8 | A-1 | B-2 | 1.42 | ○ | 98 | 1.41 | ○ | ○ |
| 9 | A-1 | B-3 | 1.41 | ○ | 99 | 1.39 | ○ | ○ |
| 10 | A-1 | B-4 | 1.44 | ○ | 98 | 1.41 | ○ | ○ |
| 11 | A-1 | B-5 | 1.43 | ○ | 98 | 1.40 | ○ | ○ |

Note: ○: Practically none. x: Found a lot.

As seen from Table 3, when no zinc stearate was added to the toner (Comparative Examples 1–2 and 4), the filming occurred after 50,000-sheet developing. Further, when an excess amount of zinc stearate was added to the toner (Comparative Example 3), the background fogging occurred much. When the molecular weight of the binder resin was larger than that of the present invention (Comparative Examples 4 and 5), the fixing of the toner was insufficient as shown by the fixing strength of less than 90%.

As described above, the developer of the present invention is good in fixing ability at low temperature, preferably 180° C. or lower and can produce a high quality image of a high image density and free from fogging and filming even after a repeated developing operation for a long period of time and a recording of a large number of sheets in a latent image-developing apparatus employing toner-recycling system. Since the developer of the present invention involves no problem remaining in the prior art, the present invention enables the toner particles to be effectively reused.

What is claimed is:

1. A developer for developing an electrostatic latent image by a developing method of a type in which residual toner particles on an image-bearing member are recovered therefrom and reused for developing said electrostatic latent image, comprising a magnetic toner and a magnetic carrier, wherein said magnetic toner comprises:

35–85 weight % of a binder resin having a number average molecular weight of 2000–100,000, a weight average molecular weight of 5,000–500,000, and a melt viscosity of $10^3$ to $10^5$ P at 120° C.;

1–10 weight % of a release agent having a softening point of 60° to 160° C.; and 10–60 weight % of a magnetic powder, said magnetic toner having a surface treating agent externally added on a surface thereof, the surface treating agent consisting of a fine powder of at least one metal salt of stearic acid, a fine powder of at least one inorganic oxide selected from the group of silica, alumina, titanium oxide, zinc oxide, antimony oxide, tin oxide and cerium oxide, and optionally a fine resin powder mainly comprising a fluorine resin powder.

2. The developer according to claim 1, wherein said fine powder of at least one metal salt of stearic acid, said fine powder of at least one inorganic oxide and said optional fine resin powder are added to the surface of said toner in an amount of 0.05–1 part by weight, 0.5–2 parts by weight and 0.1–1 part by weight, respectively, based on 100 parts by weight of said magnetic toner.

3. The developer according to claim 1, wherein a number average particle size of said surface treating agent is 0.001–2 μm.

4. The developer according to claim 1, wherein a weight average particle size of said magnetic carrier is 10–100 μm.

5. The developer according to claim 1, wherein a volume average particle size of said magnetic toner is 5–15 μm.

6. The developer according to claim 1, wherein a toner concentration in said developer is 10–95 weight % based on the amount of said developer.

7. A process for reducing filming of a toner on a surface of an image-bearing member, background fogging and offset while ensuring a fixing of toner images on a recording sheet at a low temperature in developing an electrostatic latent image with a developer having a magnetic carrier and a magnetic toner, the process comprising the steps of:

recovering residual magnetic toner particles on said image-bearing member; and reusing said residual magnetic toner particles to develop the electrostatic latent image, wherein said magnetic toner includes:

35–85 weight % of a binder resin having a number average molecular weight of 2,000–100,000, a weight average molecular weight of 5,000–500,000, and a melt viscosity of $10^3$ to $10^5$ P at 120° C.;

1–10 weight % of a release agent having a softening point of 60° to 160° C.; and 10–60 weight % of a magnetic powder;

said magnetic toner having a surface treating agent externally added on a surface thereof, the surface treating agent consisting of a fine powder of at least one metal salt of stearic acid, a fine powder of at least one inorganic oxide selected from the group of silica, alumina, titanium oxide, zinc oxide, antimony oxide, tin oxide and cerium oxide, and optionally a fine resin powder mainly comprising a fluorine resin powder.

8. The process according to claim 7, wherein said fine powder of at least one metal salt of stearic acid, said fine powder of at least one inorganic oxide and said fine resin powder are added to the surface of said toner in an amount of 0.05–1 part by weight, 0.5–2 parts by weight and 0.1–1 part by weight, respectively, based on 100 parts by weight of said magnetic toner.

9. The process according to claim 7, wherein a number average particle size of said surface treating agent is 0.001–2 μm.

10. The process according to claim 7, wherein a weight average particle size of said magnetic carrier is 10–100 μm.

11. The process according to claim 7, wherein a volume average particle size of said magnetic toner is 5–15 μm.

12. The process according to claim 7, wherein a toner concentration in said developer is 10–95 percent by weight based on the amount of said developer.

* * * * *